US005088522A

United States Patent [19]

Rath et al.

[11] Patent Number: 5,088,522

[45] Date of Patent: Feb. 18, 1992

[54] PUMP HOSE FOR A PERISTALTIC PUMP

[75] Inventors: Dieter Rath; Fredrich von der Haar, both of Melsungen; Hans-Josef Gerlach, Marsberg; Reinhard Knuth, Melsungen, all of Fed. Rep. of Germany

[73] Assignee: B. Braun Melsungen AG, Melsungen, Fed. Rep. of Germany

[21] Appl. No.: 496,792

[22] Filed: Mar. 21, 1990

[30] Foreign Application Priority Data

Mar. 23, 1989 [DE] Fed. Rep. of Germany ..... 3909657

[51] Int. Cl.[5] ..... B32B 7/04; F16L 11/14

[52] U.S. Cl. ..... 138/119; 251/7; 417/474

[58] Field of Search ..... 138/118, 119, 111, 137, 138/110, 45; 417/394, 474, 477; 210/93, 195.2; 251/6, 7

[56] References Cited

U.S. PATENT DOCUMENTS

| | | | |
|---|---|---|---|
| 2,925,045 | 2/1960 | Mascaro | 417/477 |
| 3,176,622 | 4/1965 | Pfeiffer | 417/477 |
| 3,295,556 | 2/1967 | Gertsma | 138/119 |
| 3,749,133 | 7/1973 | Bochory | 138/119 |
| 4,080,113 | 3/1978 | Legeay | 138/118 |
| 4,131,399 | 12/1978 | Calvet | 138/119 |
| 4,250,872 | 2/1981 | Tamari | 417/394 |
| 4,424,009 | 2/1984 | Van Os | 417/394 |
| 4,478,661 | 10/1984 | Lewis | 138/119 |
| 4,515,536 | 5/1985 | Van Os | 138/119 |
| 4,688,753 | 8/1987 | Tseng et al. | 251/7 |
| 4,702,675 | 10/1987 | Aldrorandi et al. | 73/730 |
| 4,725,205 | 2/1988 | Cannon et al. | 417/474 |

FOREIGN PATENT DOCUMENTS

| | | | |
|---|---|---|---|
| 0055267 | 5/1977 | Japan | 138/119 |

*Primary Examiner*—Daniel M. Yasich

*Attorney, Agent, or Firm*—Spensley Horn Jubas & Jubitz

[57] ABSTRACT

A pump hose for a peristaltic pump consists of two arcuate portions that merge along kink lines so that the undeformed hose lumen has the cross-sectional shape of a convex lens. The joinings of the arcuate portions are joined by outwardly extending ribs. When the hose is pressed, only minor squeezing occurs at the joinings. The hose has a considerably improved squeezing and restoring behavior. The ribs prevent an excessive squeezing.

7 Claims, 1 Drawing Sheet

PUMP HOSE FOR A PERISTALTIC PUMP

BACKGROUND OF THE INVENTION

1. Field of the Invention

The present invention relates to a pump hose for a peristaltic pump.

2. Related Art

In the field of medicine, peristaltic pumps or hose pumps are used as infusion pumps. Such pumps allow a sterile transport of larger quantities of an infusion liquid. The replaceable pump hose is a cheap one-way product delivered in a sterile manner that can be inserted into the infusion device by the user and is disposed after use. However, high requirements are to be met by the pump hose concerning flexing properties, elasticity, resistance to abrasion and stability in dimension. The delivery volume depends on the cross-sectional dimensions and on the restoring properties of the pump hose. Further, the material used must be physiologically safe; i.e., it must be inert to the media used. Environmental influences, such as temperature, air humidity, light and disinfectants must not affect the material.

Normally, pump hoses for peristaltic pumps are made of highly elastic material; e.g., silicon, with a high stability in dimension. The pump hose is inserted into the infusion conduit through special connection members that may serve as fastening means. The known pump hoses have a round cross section. If a hose with a round cross section is squeezed by an external force acting on it, a non-uniform strain results on the material with a heavy strain being placed in particular on the kinkings of the hose cross section. The strain on the material is even increased, since the degree of squeezing of the hose not only causes the two hose wall portions to contact each other, but also since an excessive force is applied for effecting a safe squeezing which causes a compression of the hose halves flatly abutting each other. Since such squeezing is often repeated with peristaltic pumps, symptoms of fatigue of the hose material occur. Moreover, there is the danger of abrasion of hose material within the hose, whereby foreign particles may get into the infusion solution. A very strong squeezing of the material occurs on the inner side of the hose at the kinking lines thereof resulting from the hose squeezing, whereas strong extensions occur on the outside. Further, the peristaltic pumps are subjected to tolerances due to which the degree of the squeezing of the hose varies. All these facts lead to a change in the volume of the hose during use, which results in a varied delivery or infusion rate.

A further disadvantage of the known pump hoses is that the hose wall is resilient only to a low degree, due to the required high restoring capacity, and that the measurement of the fluid pressure by means of pressure sensors elastically pressing against the hose wall from outside is made harder. Finally, another disadvantage is represented by the necessity of providing additional fastening means on the pump hose.

A pump hose is known from German Pat. Publication No. 31 12 837 A1, wherein two arcuate portions enclose the hose lumen so that the hose lumen takes the form of an ellipse. Ribs which extend laterally in opposite directions are provided. These ribs serve to position the pump hose within the hose pump. Their thickness is not substantially greater than the wall thickness of the arcuate portions. When squeezing the pump hose, the pressure rollers act exclusively on the arcuate portions that are pressed against each other. There is no pressing or supporting in the area of the ribs.

Besides various other hose forms, U.S. Pat. No. 4,540,350 discloses a pump hose consisting of two sheets laid flatly upon each other and connected along their edges. Thereby, lateral ridges are obtained, the thickness of which is twice the thickness of an arcuate portion. However, this hose is preformed to the squeezed condition. Such a hose has practically no restoring capacity for drawing off liquids. Further, there is a danger of leaking occurring in the area of the connected sheet edges, particularly after a repeated deformation of the hose.

It is an object of the present invention to provide a pump hose in which the local strain on the material during the squeezing is reduced so that damage to the material is avoided and an improved restoring behavior is achieved.

SUMMARY OF THE INVENTION

In accordance with the present invention, this and other objectives are achieved by providing a pump hose having a lumen defined by two arcuate portions abutting each other, with kink lines being formed within the hose at the joinings of the arcuate portions. Thus, the cross section of the hose lumen resembles a convex lens. This configuration of the hose walls reduces the force to be applied by the peristaltic pump for an occlusive closing of the hose.

The pressing of the hose walls is reduced by reducing the kink angle that corresponds to the tangential angle, and, further, by having to squeeze less hose material along the kink lines. Thus, the pump hose is preformed with a view to the intended squeezing, resulting in a reduction of the strain on the material occurring upon squeezing. This also reduces or eliminates the abrasion of the hose, particularly in the area of the two squeeze lines.

An essential reduction of the strain on the material is achieved by providing ribs which extend outwardly from the joinings of the arcuate portions, the thickness of which ribs equals approximately the sum of the thicknesses of the two arcuate portions. Thus, a part of the occlusion force acting on the hose from outside and additionally squeezing the arcuate hose portions, is absorbed by the ribs. In this way, tolerances of the infusion apparatus may be eliminated from the force acting on the hose.

The invention achieves a reduction in particle abrasion by a lower pressure load acting on the material of the pump hose. Further, the service life of the pump hose is extended and the constancy of the delivery volume during the infusion time is increased. The ribs also effect an improvement in the lateral stability of the pump hose.

The restoring force of the pump hose makes it possible to draw off liquids. This requires a high restoring force of the pump hose. If the hydraulic pressure within the hose is measured with a pressure sensor pressing against the outer wall of the pump hose, the restoring force of the pump hose falsifies the measured value. If the restoring force is constant and not too great, it can be considered in the evaluation of the sensor signals to obtain a reasonable measuring result. In order to keep the restoring force at a minimum in the vicinity of the sensor, the wall thickness of a certain length of the hose may be reduced with respect to the adjacent portions in a further embodiment of the invention.

According to a preferred embodiment of the invention, integrally formed fastening members are provided on the pump hose. The pump hose including the fastening members is produced as an integrally shaped part. Such a design as an integrally shaped part allows an optimum shaping of the pumping area and the area of pressure measurement. Transitions in the cross section and the surface constitution can be adapted to the desired flow conditions; i.e., transitions in the cross section may be smooth and the roughness of the inner surface may be selected such that the adherence of gas bubbles is minimized.

The pump hose of the present invention is particularly suited for use in a finger pump in which the hose is arranged linearly and supported on one side, whereas a plurality of fingers act on the hose one after the other from the opposite side, continuously squeezing the hose. The pump hose may also be used in other peristaltic pumps; e.g., in roller pumps or swash-plate pumps. Therefore, the hose need not be linear, but it may be bent over its length.

BRIEF DESCRIPTION OF THE DRAWINGS

A detailed description of a preferred embodiment of the invention will be made with reference to the accompanying drawings.

DESCRIPTION OF THE PREFERRED EMBODIMENT.

The following detailed description is of the best presently contemplated mode of carrying out the invention. This description is not to be taken in a limiting sense, but is made merely for the purpose of illustrating the general principles of the invention. The scope of the invention is best defined by the appended claims.

Figure 1:
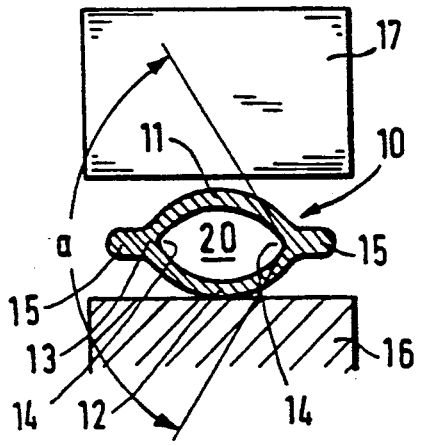
FIG. 1 shows the cross section of a hose, when not yet compressed, arranged between an abutment and a pump finger.

In cross section, the pump hose 10 of FIG. 1 has two arcuate portions 11 and 12 enclosing the hose lumen 20 such that the hose lumen 20 has the cross-sectional shaped of a convex lens. Concave kink lines 14 are formed along the joinings 13 of the arcuate portions 11 and 12. Within these kink lines, the lines tangential to the inner sides of the hose portions 11 and 12 enclose an angle a that is less than 180° and which is about 120° in the illustrated embodiment.

The arcuate portions 11 and 12 are substantially circular, the centers of the two circles being mutually offset.

The joining lines 13 of the hose portions 11 and 12 are joined by ribs 15 extending outwardly. The thickness of each rib approximately corresponds to the sum of the wall thicknesses of the two arcuate portions 11 and 12.

FIG. 1 illustrates the hose cross section in the unsqueezed state: i.e., when no outer or inner forces act on the hose. The hose 10 consists of an elastomeric material of high restoring capacity recognized as physiologically safe.

The peristaltic pump (not illustrated) contains an abutment 16 and a strut 17. Initially, the one arcuate portion 12 of the hose 10 lies loosely, at the abutment 16, with the strut 17 being arranged on the opposite side of the hose. The ribs 15 extend substantially parallel to the front faces of the abutment 16 and the strut 17.

Figure 2:
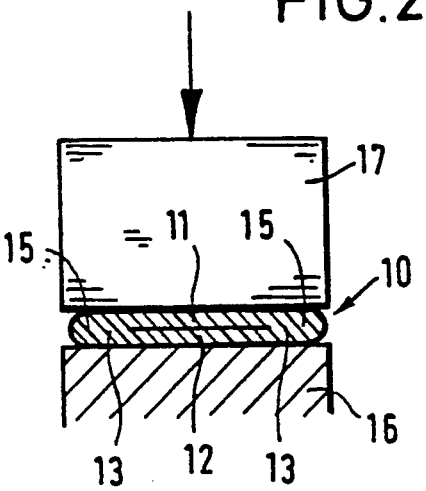
FIG. 2 shows the arrangement of FIG. 1 with the hose squeezed.

FIG. 2 illustrates the state of occlusion of the hose 10 squeezed between the strut 17 and the abutment 16. In this state, the area of the hose lumen 20 is essentially reduced to zero. There is no substantially greater squeezing of the material in the area of the joinings 13 of the initially arcuate portions 11 and 12 than occurs in the remaining areas. The ribs 15 prevent an additional squeezing of the squeezed hose 10 by the strut 17. The ribs 15 further prevent an excessive deformation of the hose by a possible wrong setting of the infusion pump, because they lie within the width of the abutment 16 of the strut 17.

Figure 3:
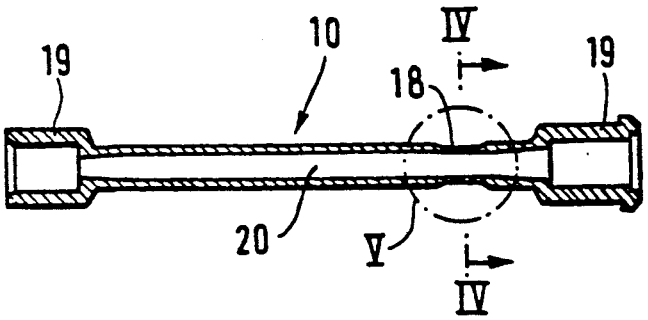
FIG. 3 shows a longitudinal section of a pump hose.
Figure 4:
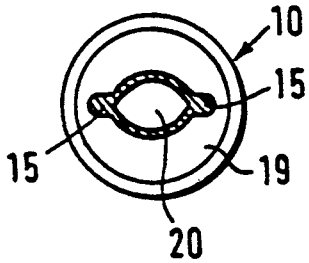
FIG. 4 shows a section along the line IV—IV of FIG. 3.
Figure 5:
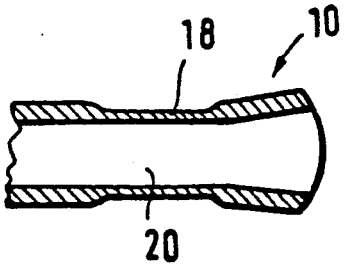
FIG. 5 shows an up-scaled detail V of FIG. 3.

FIGS. 3 to 5 illustrate a pump hose 10 having the cross section described in connection with FIG. 1. The wall thickness is reduced over a portion 18 of the length on which no struts act, so that the portion 18 of the length may be used as a pressure measuring zone to which a pressure sensor may be applied from outside for measuring the internal pressure.

Integral fastening members 19 designed as sleeves are provided at the hose ends. These fastening members 19 serve to fasten and position the hose in a peristaltic pump. At the same time, the fastening members 19 serve as connection members for connecting infusion conduits.

As illustrated in FIG. 5, the transitions in which the cross sections of the hose lumen 20 changes in the longitudinal direction are preferably continuous or kink-free, in order to obtain the best possible laminate fluid flow.

The presently disclosed embodiment is to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A hose for a peristaltic pump, the hose having a longitudinal portion for being mechanically squeezed by at least one member of the peristaltic pump at progressive locations along the length of the hose, the hose comprising:

a first arcuate portion having a thickness and defining an inner wall, a second arcuate portion having a thickness and defining an inner wall, the first arcuate portion and the second arcuate portion being substantially symmetrically disposed and being joined at at least one joining to define a lumen, the inner wall of the first arcuate portion and the inner wall of the second arcuate portion defining an opening angle at the joining of less than 180°, and at least one rib protruding outwardly from the joining, the rib having a thickness which is approximately equal to the sum of the thickness of the first arcuate portion and the thickness of the second arcuate portion.

2. The hose as set forth in claim 1, wherein the opening angle is less than 150°.

3. The hose as set forth in claim 1, comprising a length of hose having a wall thickness which is reduced relative to adjacent lengths of hose.

4. The hose as set forth in claim 1, comprising at least one integrally formed fastening member.

5. The hose as set forth in claim 1, wherein the lumen defines a substantially continuous, kink-free cross-section in a longitudinal direction.

6. The hose as set forth in claim 1, wherein the opening angle is substantially equal to 120°.

7. The hose as set forth in claim 1, wherein the first arcuate portion, the second arcuate portion and the rib are integrally formed, whereby the hose defines a continuous, one-piece, integral cross section.

* * * * *